United States Patent [19]

Mulligan

[11] Patent Number: 4,682,807

[45] Date of Patent: Jul. 28, 1987

[54] BAKED GOODS COOLING FRAME

[76] Inventor: Edward P. Mulligan, 310 Weeks St., Bennington, Vt. 05201

[21] Appl. No.: 846,014

[22] Filed: Mar. 31, 1986

[51] Int. Cl.[4] ..... A47G 19/08

[52] U.S. Cl. ..... 294/161; 211/116; 211/119.12; 294/143; 294/169

[58] Field of Search ..... 294/27.1, 32, 85, 137, 294/141–146, 159–163, 167, 169; 211/16, 41, 113, 116, 119.12; 223/85, 88, 91; 248/205.1, 317, 318, 339

[56] References Cited

U.S. PATENT DOCUMENTS

| | | | |
|---|---|---|---|
| 152,550 | 6/1874 | Collins | 294/143 X |
| 617,284 | 1/1899 | Darnes | 294/142 X |
| 618,317 | 1/1899 | Anderson | 294/169 X |
| 1,519,874 | 12/1924 | Page | 294/161 X |
| 1,556,384 | 10/1925 | Vehling et al. | 294/161 X |
| 1,723,551 | 8/1929 | Lingres | 294/161 X |
| 1,888,141 | 11/1932 | Orth | 294/161 X |
| 2,845,183 | 7/1958 | Paulsen | 294/161 X |
| 2,917,212 | 12/1959 | Parker | 223/88 |
| 3,202,329 | 8/1965 | Schmidt | 211/119.12 X |
| 4,329,789 | 5/1982 | Erickson | 211/113 X |

*Primary Examiner*—Johnny D. Cherry
*Attorney, Agent, or Firm*—Arthur K. Hooks

[57] ABSTRACT

A cooling frame includes a holding member in which a standard pie plate and/or a cake cooling plate may be nested. A top handle portion is adapted to be clamped to a clothes line. A hinge with hinge pin orthogonal to the clothes line connects the handle portion with the holding member portion of the frame so that the hot baked goods is suspended horizontally, and being hot and subject to plastic flow does not run. A netting or other barrier to birds and insects may be included for pulling down over the baked goods.

6 Claims, 3 Drawing Figures

BAKED GOODS COOLING FRAME

BACKGROUND OF THE INVENTION

This invention relates to frames or racks for holding hot baked goods for cooling, and more particularly pertains to a hot-baked-goods holding frame that holds and suspends the baked goods in a horizontal position from a clothes line or the like.

SUMMARY OF THE INVENTION

A baked-goods cooling frame for being suspended from a clothes line or the like includes at least one holding means for holding one baking plate containing hot baked goods. A handle means is connected to the baked-goods holding means for pendantly and non-slidably attaching the holding means to and suspending it from an approximately-horizontal elongated element such as the clothes line.

This invention takes note of the habit of many domestic cooks to cool baked goods out of doors and recognizes the potential for recruiting the ubiquitous clothes line for this purpose.

DESCRIPTION OF THE PREFERRED EMBODIMENTS

Figure 1:
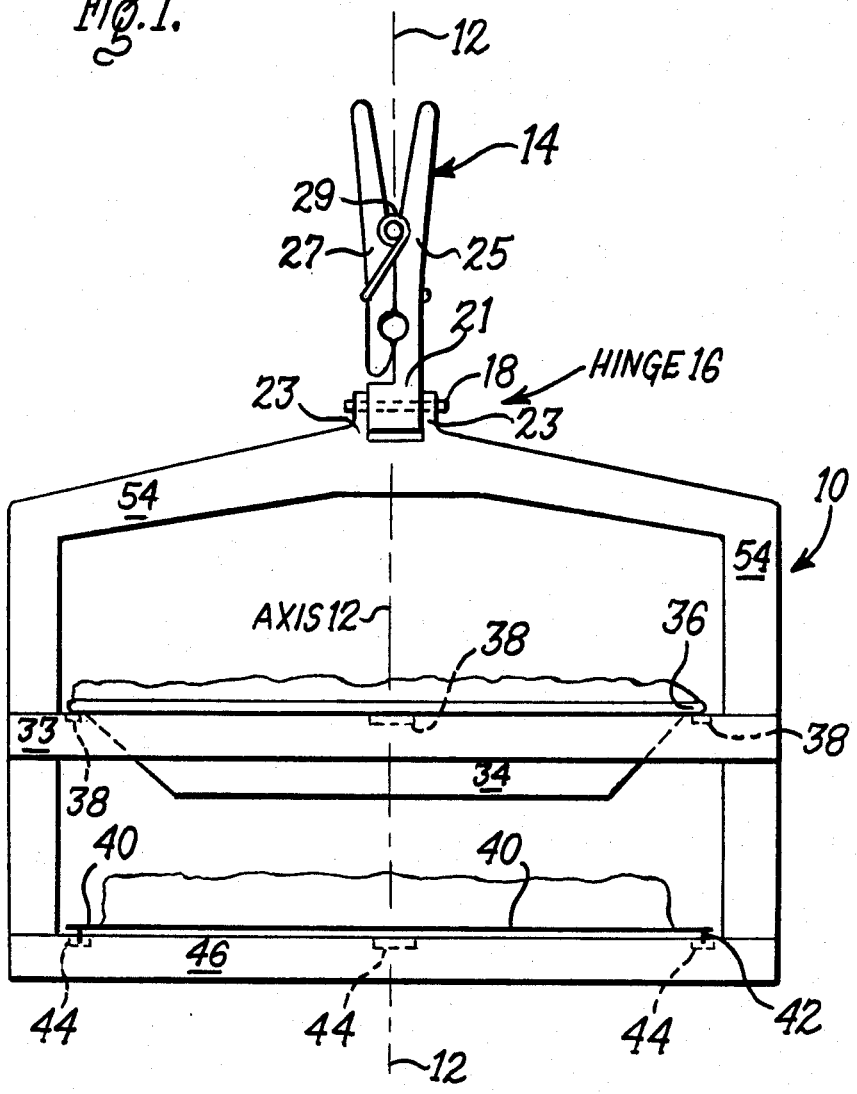
FIG. 1 shows in end view a baked-goods cooling frame of this invention holding a pie and a cake.
Figure 2:
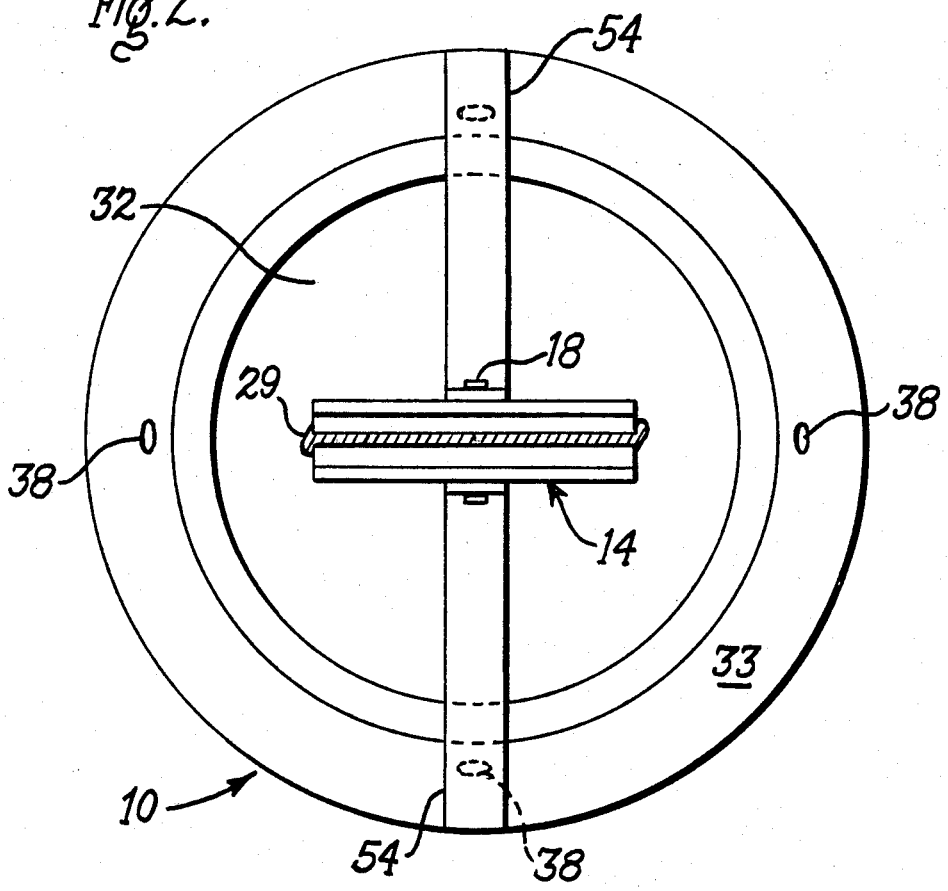
FIG. 2 shows in top view the cooling frame of FIG. 1.
Figure 3:
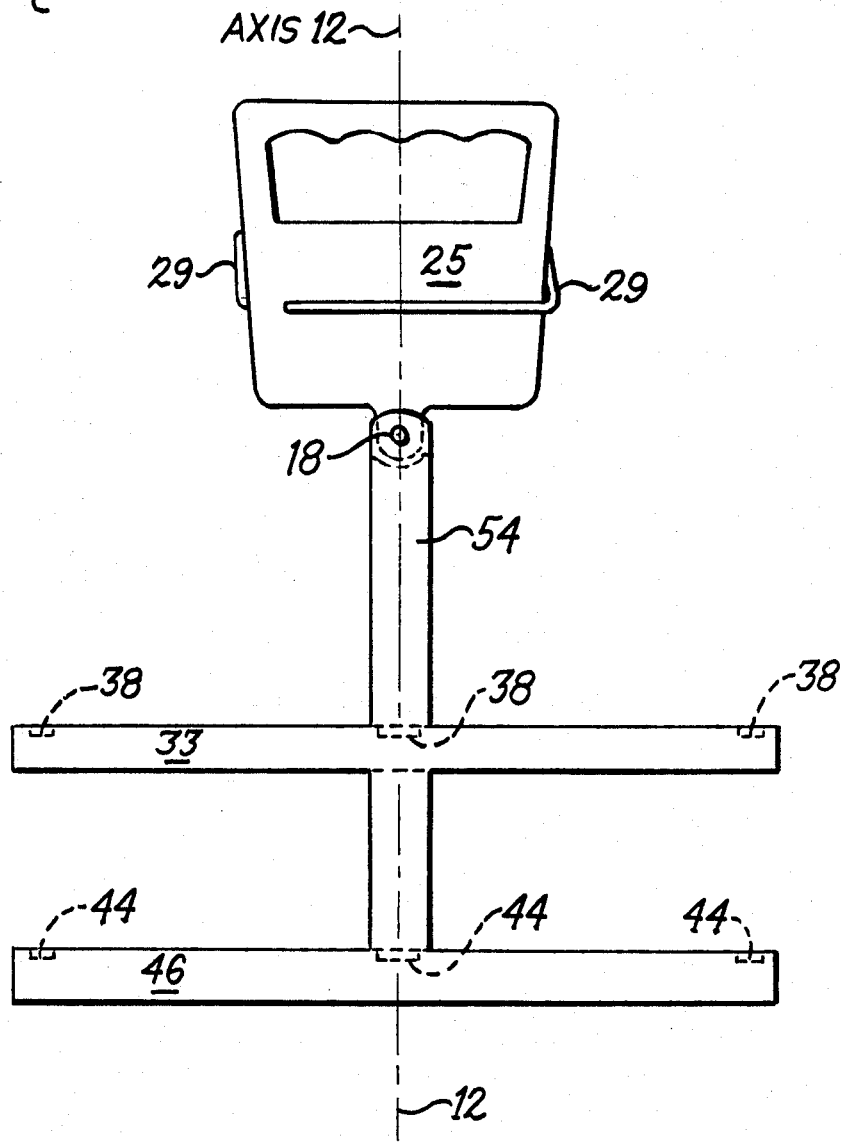
FIG. 3 shows in side view the cooling frame of FIG. 1 taken at right angles to the end view.

With reference to FIGS. 1, 2 and 3 a mechanical frame 10 that is symmetrical about an axis 12 is connected to a handle 14 by a hinge 16 having a hinge pin 18. The hinge 16 is comprised of a lower handle portion 21 and an upper frame portion 23.

The handle 14 is comprised of three discrete parts, a main part 25, a mating part 27 and a spring 29. In the end view of FIG. 1 the handle 14 is seen to be configured like a common clothes pin, wherein the main part 25 and the mating part 27 are held together by spring 29. By manually pinching the top portions of parts 25 and 27, the lower portions open and may be snapped over a clothes line or other approximately-horizontally-mounted elongated element, to grip that element when released. The hinge pin 18 is thus positioned orthogonally with respect to mating half-round slots provided in parts 25 and 27 for gripping the clothes line. In upper portions of the parts 25 and 27 there are provided, respectively, two mutually aligned holes designed for inserting the fingers of a hand for transporting the frame 10.

The frame 10 includes a horizontal annular holding member 33 that is adapted for supporting and holding a standard pie plate 34. The circular port 32 in member 33 shares the axis 12 and is beveled to more intimately conform to the pie plate 34. The port in holding member 33 has a diameter about equal to the standard pie plate 34 minus its flange 36.

Also a feature of holding member 33 are four short indentations or grooves 38 that are positioned in the upper surface thereof at a spacing to receive and hold the feet of a standard cake cooler plate. Such a cake cooler plate 40 is illustrated in FIG. 1 having feet 42 registered with and resting within similar indentations 44 in a second holding member 46 that is also a part of the frame 10. Holding member 46 is also coaxial with member 33 above and parallel thereto so that in this cooling frame two pies or two cakes or one of each may be simultaneously held for cooling. When the handle 14 is clamped to a clothes line or the like, the baked goods will always hang in the symmetrical frame 10 below the line in horizontal positions, the hinge 16 accommodating any degree of non-horizontal direction that the clothes line may assume.

A netting (not shown) may be attached to the frame 10 near the hinge 18. It may then envelop the frame 10 and be tied by a wire clip below to keep away insects or birds from the baked goods.

The holding member portions 33 and 46 are preferably of a material such as a metal that does not scorch or otherwise deteriorate at temperatures as high as 450° F. Members 33 and 46 may be attached to the remaining portion of the frame 10, namely the chassis portion 54, that may be made of a thermoplastic or other less heat resistant material. Of course, the frame 10 may be molded of a high temperature plastic in one unitary piece.

Many other variations and modifications are contemplated as falling within the scope and concept of this invention. For example, a third, fourth, etc. holding member, coaxially mounted under members 33 and 46, may be included as a part of the frame 10. Further, the frame holding members may be rectangular rather than round as described here. And of course, the chassis portion of the frame has the function of tying together mechanically the holding members in a coaxial manner with the hinge.

What is claimed is:

1. A baked goods cooling frame comprising:

(a) at least one holding means for holding one baking plate containing hot baked goods;

(b) a handle means, connected to said at least one holding means, for pendently attaching to and suspending said holding means from an approximately horizontally-mounted elongated element, said handle means having a spring loaded clamp for being clamped over and broadly gripping said elongated element, said handle means including a hinge means for hingedly connecting said holding means to said handle means, said hinge means including a hinge pin that is orthogonal to the direction of an elongated element to which said clamp may be attached so that said plate is held in a horizontal position regardless of the degree by which said elongated element deviates from an exactly horizontal position.

2. The cooling frame of claim 1 wherein said handle means includes a manual grip portion for manually transporting said cooling frame.

3. The cooling frame of claim 1 wherein said handle means is more particularly for pendantly and non-slidably attaching said holding means to a flexible line such as a clothes line that is mounted substantially horizontally between two spaced apart vertical structures.

4. The cooling frame of claim 1 wherein said holding means is comprised of an annular member having a circular opening in which there may be nested a pie plate held horizontally in said annular member while being mostly exposed to the ambient air.

5. The cooling frame of claim 1 wherein said holding means is comprised of an annular member having a central opening therein and a peripheral portion including indentations in a top surface thereof, said indentations having the spacings of the feet of a cake cooling plate so that said cake cooling plate can be nested and held horizontally in said annular member while being mostly exposed to the ambient air.

6. The cooling frame of claim 1 additionally comprising at least another holding means for holding horizontally another baking plate containing hot baked goods underneath, concentric with and spaced from said one holding means.

* * * * *